United States Patent [19]

Growney

[11] 4,117,924

[45] Oct. 3, 1978

[54] DISPLAY CARTON

[75] Inventor: Lawrence J. Growney, Pearl River, N.Y.

[73] Assignee: Federal Paper Board Co., Inc., Montvale, N.J.

[21] Appl. No.: 808,436

[22] Filed: Jun. 20, 1977

[51] Int. Cl.[2] ..... B65D 5/50

[52] U.S. Cl. ..... 206/45.14; 206/45.31; 206/583

[58] Field of Search ..... 206/45.14, 45.19, 45.31, 206/45.34, 491, 562–563, 521, 588, 590, 583; 229/14 C, 16 D, 34 HW, 39 B

[56] References Cited

U.S. PATENT DOCUMENTS

| | | | |
|---|---|---|---|
| 3,388,787 | 6/1968 | Growney | 206/45.14 |
| 3,680,687 | 8/1972 | D'Alessio | 206/45.14 |
| 3,747,831 | 7/1973 | Hanson | 206/45.14 X |
| 3,887,067 | 6/1975 | Collura et al. | 206/45.14 |

FOREIGN PATENT DOCUMENTS

| | | | |
|---|---|---|---|
| 1,049,905 | 11/1966 | United Kingdom | 206/45.14 |

*Primary Examiner*—Steven E. Lipman
*Attorney, Agent, or Firm*—Guy A. Greenawalt

[57] ABSTRACT

A shadow box style carton for merchandise, such as a product packaged in a tube or bottle, which carton is formed from a single paperboard blank and which is in the form of a collapsible tube with end closure flaps and a partially open front or top through which at least part of the merchandise may be viewed, the carton having display receiving panels extending inwardly in diagonal planes from hinged connections at opposite sides of the opening and connected to an inside wall remote from the hinged connections so that space for the merchandise is provided which is flanked by display receiving panel space on each side of the merchandise.

6 Claims, 19 Drawing Figures

FIG. 1
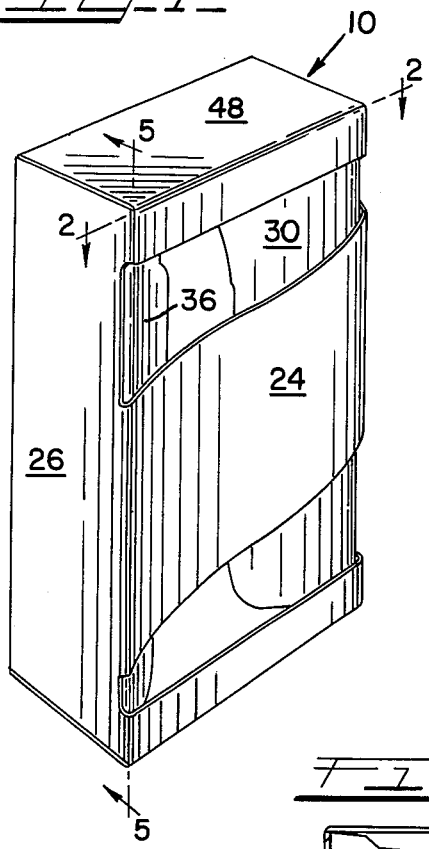
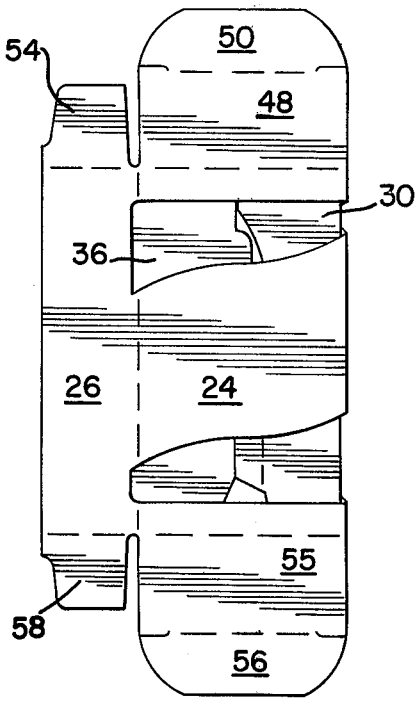
FIG. 2
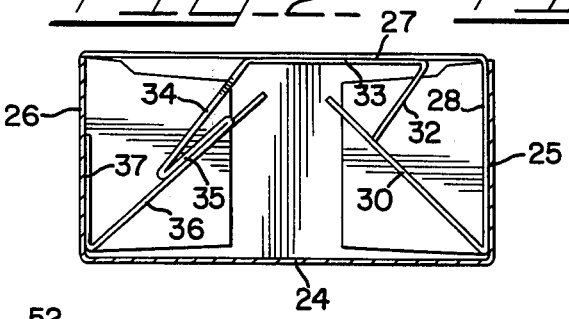
FIG. 3
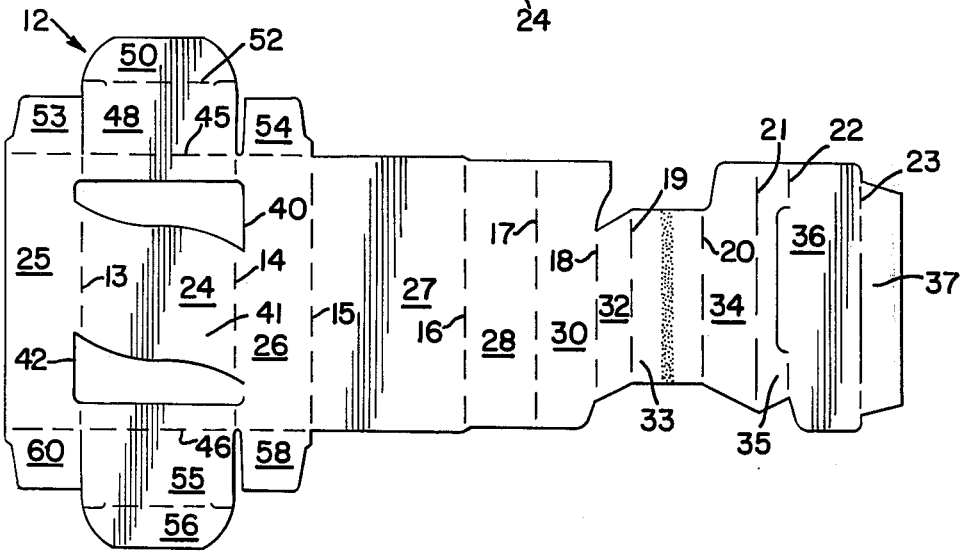
FIG. 4

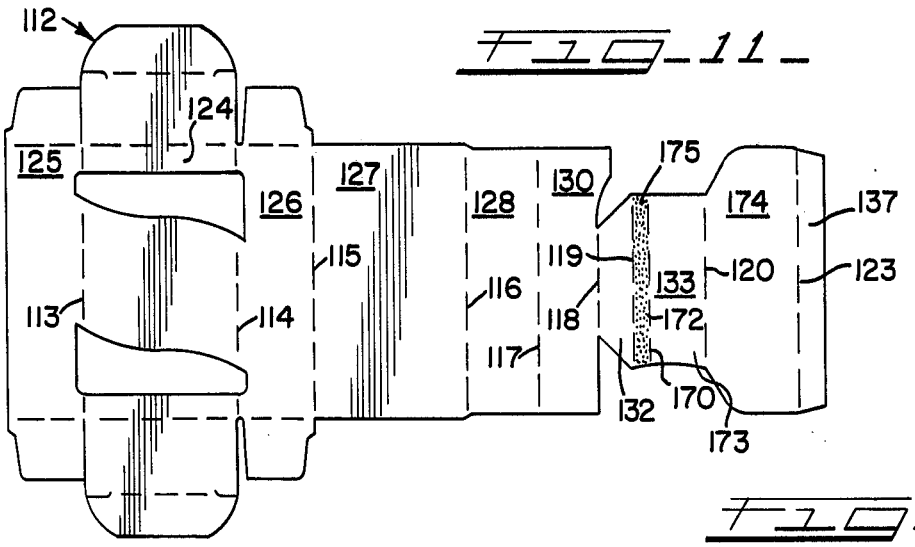
FIG. 11
FIG. 13
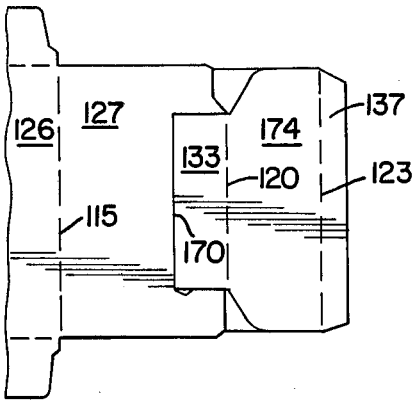
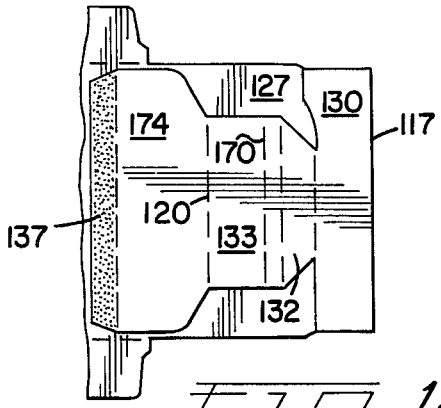
FIG. 12
FIG. 14
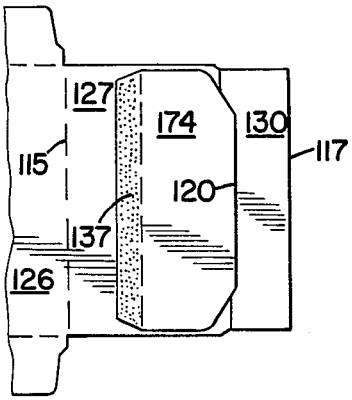
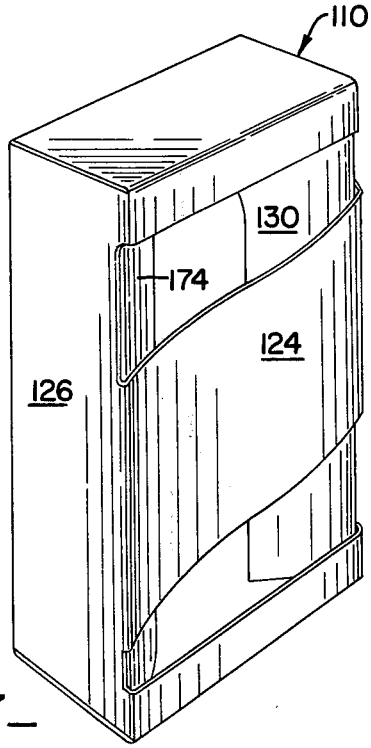
FIG. 17

DISPLAY CARTON

BACKGROUND OF THE INVENTION

This invention relates to packaging and is more particularly concerned with improvements in a carton formed of paperboard, or other foldable sheet material, for holding a generally elongate article, such as, a bottle or tube, with portions of the article visible through openings in a wall of the carton.

Cartons have heretofore been provided for marketing various articles, particularly articles having the configuration of a tube or bottle, which cartons have a partially open face through which at least a portion of the article can be observed. Some cartons of this general type, commonly known as shadow boxes, have become popular for holding and displaying products such as, for example, medicines and health and beauty care items, which are marketed in bottles or tubes. Generally, such cartons have the appearance of a shallow, elongate tray which is adapted to be set upright on a narrow end to display an elongated bottle or tube through an open or partially open side which constitutes the front of the display carton. In some forms the carton may be provided with a means for locking the bottle or tube in the desired position therein. In some styles of this type carton there is provided a single panel back or bottom having slide and end walls hinged thereto, one or more of which will incorporate structure forming retention means for the article. In another form of the carton which is designed for marketing products packed in relatively thin, elongate tubes, one of the board panels forms the back of the display and the opposite board panel is cut to form the front and also to provide flaps for closing the carton ends and confining the articles. Generally, the outside surface of the carton has been relied upon for printing thereon instructions or display material relevant to the use or advantages of the product which is being marketed. In a recently developed form of this type display carton the article is trapped betwen the one sidewall of the carton and a display panel which, in part, extends in a diagonal plane inwardly of the opposite sidewall and which has an inner portion cooperating with the back wall and the sidewall in forming a pocket in which the article is adapted to be retained. Such an arrangement is disclosed in U.S. Pat. No. Re 28,530 granted to Joseph R. D'Allessio on Aug. 26, 1975.

It is a general object of the present invention to provide a carton of the type referred to for use in the marketing of bottled or tubed products which may be formed with a high degree of economy from a single blank of paperboard or similar material, which has provision for retaining the bottle or tube in a generally centered position between oppositely disposed sidwall panels while providing for a substantial amount of accompanying display material, all of which provides the resultant package with a neat and attractive appearance.

A more specific object of the invention is to provide a shadow box style display carton for articles, such as tubes or bottles, wherein provision is made for holding the tube or bottle in a nearly centered position in the carton so as to attractively display the same while providing space for display advertising or illustration of the use of the product along both sides thereof, without increasing the size of the carton to an undesirable degree and with provision for retaining the article therein in an attractive manner.

Another object of the invention is to provide a display carton having the general form of tray, with a front or top wall which is partially open and with means for retaining the article to be displayed therein which means is in the form of supplemental panels extending diagonally from the side edges of the opening in the front or top wall to a point intermediate the side edges of a back wall panel, which provides space in which the article is cradled and also space alongside the same for instructions in the use of the article, or display material of a desired character.

To this end the invention as disclosed and claimed herein comprises a display carton which is formed from a single cut and scored blank of paperboard or similar material so as to provide hingedly connected front, back and sidewalls and an internal cradle arrangement of hingedly connected panels which include inwardly slanted display panels extending in hinged relation from adjacent the hinge connections of the front with the sidewalls between inner portions of which a tube, jar or other product container member is adapted to be positioned.

These and other objects and advantages of the invention will be apparent from a consideration of the several forms of the display carton which are illustrated in the accompanying drawings wherein:

BRIEF DESCRIPTION OF THE DRAWINGS

FIG. 1 is a perspective view of a display carton in set up and closed condition, which embodies the principal features of the invention;

FIG. 2 is a cross section taken on line 2—2 of FIG. 1, to an enlarged scale;

FIG. 3 is a plan view of the carton of FIG. 1, in collapsed condition, with the front face and one side face showing;

FIG. 4 is a plan view, showing the inside face of the blank which is employed in fabricating the carton of FIG. 1;

FIG. 11 is a plan view, showing the inside face of a blank which is employed in fabricating a modified form of the carton;

FIG. 12 is a partial plan view showing the one end of the blank of FIG. 11 following the first folding operation which is employed in fabricating the carton in collapsed condition;

FIG. 13 is a partial plan view showing the end portion of the blank of FIG. 11 following the second folding operation;

FIG. 14 is a partial plan view showing the end portion of the blank of FIG. 11 following the third folding operation;

FIG. 17 is a perspective view of the completed carton which is formed from the blank of FIG. 11 in final set up and closed condition;

DESCRIPTION OF THE PREFERRED EMBODIMENTS OF THE INVENTION

Figure 5:
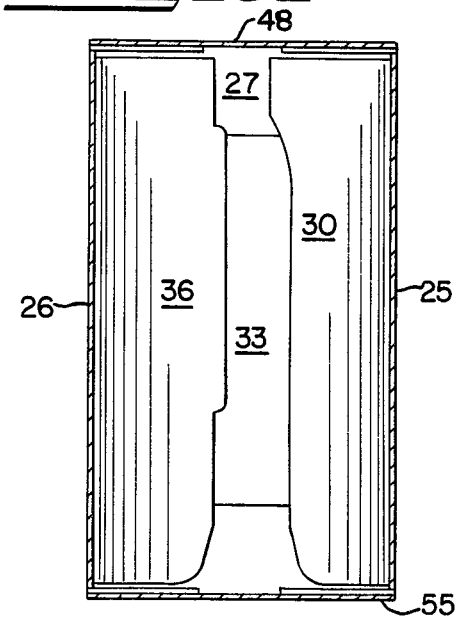
FIG. 5 is a sectional view taken on the line 5—5 of FIG. 1, to an enlarged scale.
Figure 10:
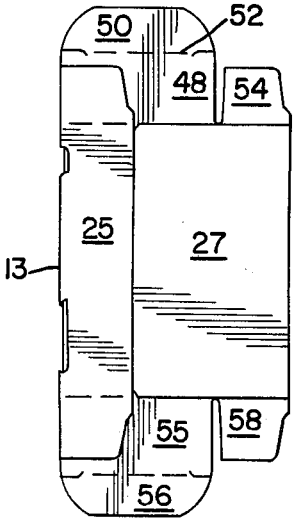
FIG. 10 is a plan view of the completed carton in collapsed condition, with the back face and one side face showing.

Referring first to the carton 10 which is illustrated in FIGS. 1 to 10, the carton is fabricated, in initially collapsed condition, from a generally rectangular, elongate, paperboard blank 12 which is cut and scored as shown in FIG. 4. The blank 12, which is shown with the inside face uppermost, is divided by parallel, transverse score lines 13, 14, 15, 16, 17, 18, 19, 20, 21, 22 and 23 which are longitudinally spaced so as to divide the blank into a series of generally rectangular panels including a front wall forming panel 24, adjoining side wall forming panels 25 and 26, a back wall panel 27, and an inner side wall reinforcing panel 28 which reinforcing panel extends between the transverse score lines 16 and 17 and serves as a glue panel for connecting in face engaging relation with the side wall panel 25 and also cooperates with the panels 24, 25, 26 and 27 in forming a tubular body, when the carton is set up (FIGS. 2 and 5). The side wall reinforcing panel 28 is separated by the score line 17 from an extended end section of the blank which is subdivided by the score lines 18, 19, 20, 21, 22 and 23 so as to provide a collapsible partition and display structure comprising a display panel 30 and an associated hinge forming panel 32 which is adapted to join the panel 30 to a back wall connecting panel 33, a hinge panel 34 with an associated glue panel 35, a second display panel 36 which has an associated glue panel or glue tab 37, the last panel 37 constituting the terminal portion of the blank and being adapted to be secured to the side wall panel 26 so as to form a hinged connection between the side wall panel 26 and the display panel 36 of the partition and display structure.

The front wall forming panel 24 is cut out in areas adjacent the upper and lower ends so as to provide contents viewing apertures 40 and 42 of more or less decorative outline, both apertures extending a slight distance into the side wall forming panels 25 and 26. The outboard cutting lines 43 and 44 for the apertures 40, 42 are spaced a short distance from hinge forming score lines 45 and 46 and the viewing apertures 40 and 42 are relatively small, providing between them an area 47 of substantial size suitable for display printing, or the like, if desired. A top closing flap 48 extends outwardly of the score line 45 and has a tuck-in panel 50 separated therefrom by the hinge forming score line 52. End flaps 53 and 54 are provided as hinged extensions of the side wall forming panels 25 and 26. At the opposite side of the blank a bottom closing panel 55 extends outwardly of the score line 46 and has a tuck-in panel 56 separated therefrom by the hinge forming score line 57. End flaps 58 and 60 are provided as hinged extensions of the side wall panels 25 and 26 and cooperate with the panel 55 in closing the bottom end of the carton.

Figure 6:
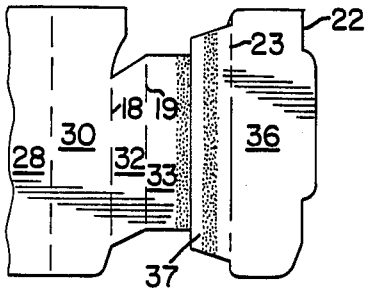
FIG. 6 is a partial plan view showing the one end of the blank of FIG. 4 following the first folding operation which is employed in fabricating the carton in flattened condition.
Figure 7:
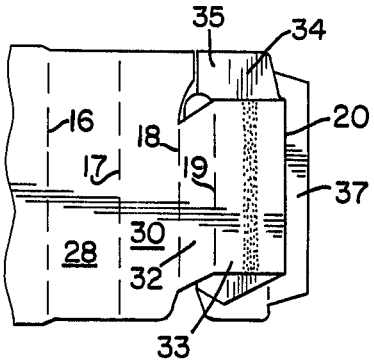
FIG. 7 is a partial plan view showing the end portion of the blank following a second folding operation.
Figure 8:
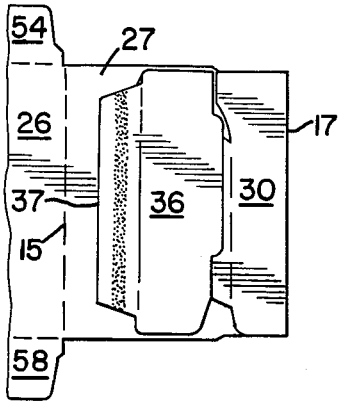
FIG. 8 is a partial plan view showing the central portion of the blank following a third folding operation.
Figure 9:
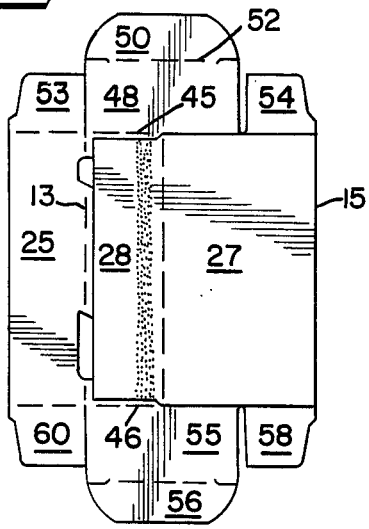
FIG. 9 is a plan view showing the blank following a fourth folding operation.

Preparatory to forming the carton in collapsed condition the cut and scored blank is provided with a line or stripe of adhesive on the inside face of the glue panel 35 which is indicated at 62 and a parallel line or stripe of adhesive 63 is applied to the panel 33. The first fold is made on the hinge line 22 which brings the panel 36 into engagement with the panels 34, 35 and the panel 37 into overlying relation with a portion of the panel 33 as shown in FIG. 6. A line or stripe of adhesive 64 is applied to the outside face of glue panel 37 as shown, after which a second or reverse fold is made on the hinge line 20 which brings the blank end portion into the position shown in FIG. 7. The next or third fold is made on the line 17 which brings the assembly of folded panels into overlying engagement with the panels 28, 27 as shown in FIG. 8, the panel 33 thereby being secured to the panel 27 by the adhesive stripe or area 63. The end panel 37 is also now in position to expose the line or stripe of adhesive 64 on the uppermost face. The fourth fold is made on the line 15 which brings the assembly of folded panels into overlying relation with the front and sidewall panels 24 and 26 and secures end panel 37 to the sidewall panel 26 by means of the adhesive stripe 64. An adhesive stripe 65 is applied to the exposed face of the side reinforcing panel 28 and the sidewall panel 25 is folded over on the hinge line 13 to complete the formation of the carton. The various stripes of adhesive may be applied in a different sequence than that described and the adhesive may be applied to the entire panel or in multiple lines or areas in each instance.

The flattened carton (FIGS. 3 and 10) is adapted to be opened up for use by applying force in the plane of the same to the opposite side edges and forcing the same inwardly toward each other which automatically hinges the panels forming the partition and display structure to the position within the tubular body which is illustrated in FIG. 2 and enables the product to be inserted at either end of the tube. The end panels are closed upon filling the tubular body to complete the package with the product in the center portion and retained in position by the display panels on each side thereof. One end may be closed, of course, before or during the insertion of the product into the other end.

A modified form of the carton is illustrated in FIGS. 11 to 17 in which provision is made for positioning the product in the central portion of the tubular body with display panel areas on both sides. The modified carton is designed for fabrication in collapsed condition and when opened in tubular form a simple manipulation of certain partition panels results in positioning the partition structure so as to automatically lock the tube in the fully open tubular position thereby enabling rapid filling from either end.

The main body structure of the modified carton is the same construction as the form thereof shown in FIGS. 1 to 10 and corresponding panels will be identified by the same numerals plus 100. As shown in FIG. 11 the generally rectangular blank 112 is cut and scored so as to provide the main body panels comprising the front wall forming panel 124, sidewall forming panels 125, 126, sidewall reinforcing panel 128, and back wall forming panel 127, all of which are the same configuration as the corresponding panels 24, 25, 26, 28 and 27 which are shown in FIG. 4 and which have like end closure panels. The one display panel 130 may be the same as panel 30 with an associated hinge panel 132 which is substantially the same as panel 32. The panel 133 which, in the completed carton, lies against and is secured to the back wall panel 127, is divided by a transverse hinge forming score line 170 so as to provide a narrow portion 172, which is adapted to be secured to the back wall panel 127 as hereinafter described, and a wider non-secured portion 173 which serves as a hinge panel in setting up the carton and locking the partition structure in final position. The other display panel 174 extends beyond the panel 133 and is adapted to hinge on the score line 120 which separates it from panel 133 and also on the hinge score line 123 which separates it from the glue panel 137 at the end of the blank.

In forming the carton from the cut and scored blank 112 an adhesive is applied to the panel portion 172, as indicated at 175, and the first fold is made on the line 117 which brings the partition panel 133 into face engagement with the back wall forming panel 127 and secures the panel portion 172 to the same by means of the adhesive 175 (FIG. 12). The second fold is made on the hinge-score line 170 in the reverse direction, that is, in the direction of the right end of the blank, as viewed in FIG. 11 and the panels are moved into the position shown in FIG. 13, after which the third fold is made on the hinge-score line 120 in direction of the left hand end of the blank as viewed in FIG. 1, which brings the panels into the position shown in FIG. 14. Adhesive is then applied to the uppermost face of the connecting glue tab or glue panel 137 and the fourth fold is made on the hinge-score line 115 which brings the glue panel 137 into engagement with the sidewall forming panel 126 adjacent the hinge-score line 114. Adhesive is then applied to the outer sidewall panel 125 or the exposed face of the inner sidewall panel 128 and the carton is completed by folding in the sidewall forming panel 125.

Figure 15:
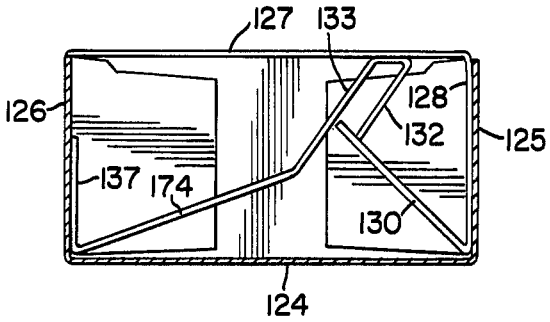
FIG. 15 is a transverse cross sectional view showing the position of the partition and display panels when the body of the carton is initially set up in tubular form.
Figure 16:
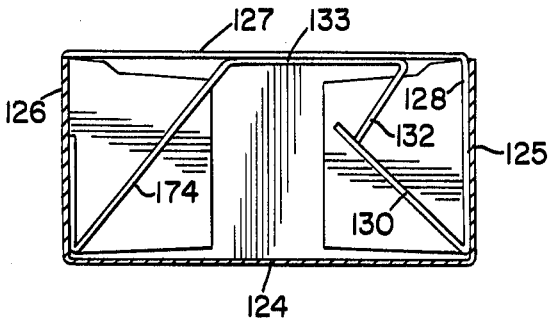
FIG. 16 is a transverse cross sectional view as in FIG. 15, but with the partition and display panels in final position.

When the collapsed carton is opened up into tubular form the partition panels 130, 132, 172, 173 and 174 will automatically move to the position shown in FIG. 15. The two panel portions 133 and 174 may then be flipped into the final locking position as shown in FIG. 16 by applying sufficient pressure to the panels in the direction of the arrow 176 (FIG. 15) so as to hinge the panel portion 173 into the plane of the portion 172 and into overlying relation with the back wall panel 127 to which the panel portion 172 is secured.

Figure 18:
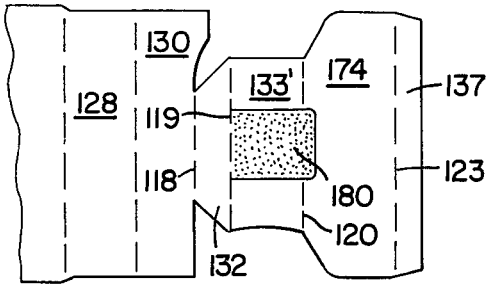
FIG. 18 is a partial plan view showing the end portion of the inside face of a blank which is employed in fabricating a further modified form of the carton.
Figure 19:
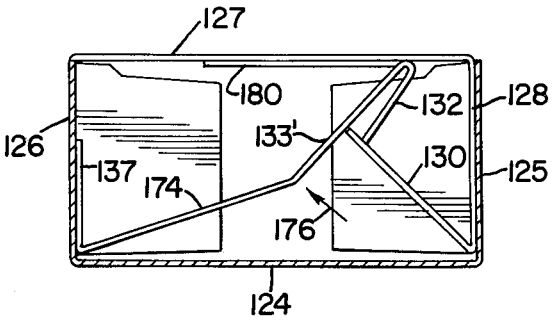
FIG. 19 is a transverse cross sectional view similar to FIG. 15 showing the position of the partition and display panels when the carton which is formed from the blank of FIG. 18 is initially set up in tubular form.

A further variation in the partition structure is illustrated in FIGS. 18 and 19 where a glue tab 180 is cut in the panel 133' and substituted for the panel portion 172. The blank is otherwise the same as in FIG. 11 with the panel 133' being otherwise in a single plane. The tab 180 is supplied with adhesive and secured to the back wall 127 in the same manner as the glue strip 172 so that the panel 133' is free to hinge on the score lines 120 and 119 as indicated in FIGS. 18 and 19 to the final position against the back wall 127, the same as panel 133 in FIG. 16.

In all of the forms of the carton illustrated, the blank is cut and scored or creased so that when the panels are hinged on the score lines or crease lines and secured in position by the glue tabs or glue panels, and the collapsed carton is set up for filling, a product receiving area or recess is provided between spaced inner margins of the pair of shadow panels and a display space or area is provided by the shadow panel surfaces on each side of the product, with the product being retained or trapped between the shadow panels.

I claim:

1. An elongate generally rectangular one piece carton blank of bendable sheet material which is divided by parallel, longitudinally spaced transverse score lines into a series of generally rectangular panels comprising a front wall forming panel having an opening of substantial size cut therein, adjoining sidewall forming panels, a back wall forming panel extending from one of said sidewall forming panels, and a partition and shadow forming panel structure extending from the transverse score line defining the side edge of said back wall forming panel which is remote from said front wall forming panel, which partition and shadow forming panel structure includes a sidewall reinforcing panel extending from said side edge score line of said back wall forming panel to a longitudinally spaced hinge forming score line separating said sidewall reinforcing panel from a first shadow forming panel, said reinforcing panel having a dimension in the direction longitudinally of the blank which is somewhat less than the corresponding dimension of the sidewall panel adjoining said back wall forming panel, said hinge forming score line defining one edge of a relatively narrow hinge forming panel, said hinge panel extending to a longitudinally spaced, transverse score line defining one edge of a back wall connecting panel having a dimension in the longitudinal direction of the blank which is substantially smaller than the corresponding dimension of said back wall panel, said back wall connecting panel extending to a longitudinally spaced transverse score line defining an opposite side edge of said back wall connecting panel, a shadow panel assembly extending to the end of the blank which is divided by spaced parallel hinge forming transverse score lines so as to provide a second shadow panel and a glue panel at the end margin of the blank, and said back wall connecting panel being subdivided by a hinge forming transverse score line to provide a relatively narrow strip adjoining said score line separating said back wall connecting panel from said hinge panel and spaced from the score line separating said back wall connecting panel from said last mentioned shadow panel assembly.

2. An elongate generally rectangular one piece carton blank of bendable sheet material which is divided by parallel, longitudinally spaced transverse score lines into a series of generally rectangular panels comprising a front wall forming panel having an opening of substantial size cut therein, adjoining sidewall forming panels, a back wall forming panel extending from one of said sidewall forming panels, and a partition and shadow forming panel structure extending from the transverse score line defining the side edge of said back wall forming panel which is remote from said front wall forming panel, which partition and shadow forming panel structure includes a sidewall reinforcing panel extending from said side edge score line of said back wall forming panel to a longitudinally spaced hinge forming score line separating said sidewall reinforcing panel from a first shadow forming panel, which hinge forming score line defines one edge of a relatively narrow hinge forming panel, said hinge forming panel extending to a longitudinally spaced, parallel score line defining one edge of a back wall connecting panel having a dimension in the longitudinal direction of the blank which is substantially smaller than the corresponding dimension of said back wall forming panel, said back wall connecting panel extending to an opposite side edge defined by a longitudinally spaced transverse score line, and a shadow panel assembly extending to the end of the blank which is divided by a parallel hinge forming transverse score line in the end margin providing a glue panel at the end of the blank, said shadow panel assembly at the end of said blank including a back wall connecting panel which is separated by longitudinally spaced hinge forming score lines from said hinge panel and from said last mentioned shadow panel assembly with a glue tab cut therein which extends from the transverse score line separating said back wall connecting panel from said hinge panel.

3. A collapsible carton formed of a one piece blank of bendable sheet material which is cut and creased to provide a plurality of hingedly connected panels which are folded and secured so that in set up condition and disposed on end said carton comprises a tubular body having a back wall, adjoining sidewalls hinged thereto, a front wall hingedly connected to forward edges of the sidewalls with one or more openings formed therein by cutting out a substantial area intermediate the top and bottom edges thereof, top and bottom closure flaps hinged to said sidewalls and to said back or front wall, and a partition and shadow panel structure disposed within said tubular body comprising a pair of shadow forming panels hingedly connected at opposite sides of a front wall opening on hinge axes substantially coinciding with the hinge axes of the connection of the front wall with the sidewalls, each of said shadow forming panels being disposed in a plane extending diagonally inwardly of the front wall opening and in the direction of the back wall and the opposite sidewall, at least a portion of the inner margin of one of said shadow forming panels being reversely folded so as to extend in the direction of the sidewall to which said shadow forming panel is connected and in the direction of the back wall, and a panel means hingedly connecting inner marginal portions of said inwardly directed shadow forming panels which panel means has a portion secured so as to lie in a fixed position against a portion of the inner face of the back wall, said panel portion being disposed intermediate the sidewalls and spaced therefrom so as to form with inner marginal portions of said shadow forming panels a forwardly open pocket of substantial width between said inner margin portions for retaining therein a generally tubular product with portions of said product visible through the front wall opening when placed in said pocket.

4. A collapsible carton as set forth in claim 3 wherein said panel means hingedly connecting inner marginal portions of said shadow forming panels comprises a pair of panel members which are hingedly connected to inner margins of said shadow forming panels and to each other on vertical hinge lines, one of said panel members being secured to said back wall and to said panel members and being proportioned and located relative to the associated wall and panel members to permit hinging the same, upon the carton being opened up into tubular form from a collapsed condition to a position where the carton back, front and sidewalls are held against collapse.

5. A collapsible carton as set forth in claim 3 wherein said panel connecting means comprises a panel portion hingedly connected to an inner marginal portion of said other one of said shadow forming panels and extending inwardly in the same generally diagonal direction of said other shadow forming panel toward said back wall, which hinged panel portion is connected in hinged relation to a panel constituting the portion of said panel connecting means which lies against said back wall.

6. A collapsible carton as set forth in claim 5 wherein said portion of said panel connecting means which lies against said back wall comprises a pair of panel members which are hinged to each other on a vertical hinge line, one of said pair of panel members being secured to said back wall and being hingedly connected to the innermost edge of said panel portion which is connected in reversely folded relation to said one shadow forming panel.

* * * * *